US006401266B1

(12) United States Patent
Mitchell et al.

(10) Patent No.: US 6,401,266 B1
(45) Date of Patent: Jun. 11, 2002

(54) WASTE OUTLET DEVICE

(75) Inventors: Geoff John Mitchell, Sandwich; Bertrand Gachot, London, both of (GB)

(73) Assignee: Eskander Corporation N.V., Curacao (NL)

( * ) Notice: Subject to any disclaimer, the term of this patent is extended or adjusted under 35 U.S.C. 154(b) by 0 days.

(21) Appl. No.: 09/485,035

(22) PCT Filed: Jul. 28, 1998

(86) PCT No.: PCT/GB98/02240

§ 371 (c)(1),
(2), (4) Date: Jun. 6, 2000

(87) PCT Pub. No.: WO99/07953

PCT Pub. Date: Feb. 18, 1999

(30) Foreign Application Priority Data

Aug. 4, 1997 (GB) ..... 9716498

(51) Int. Cl.[7] ..... E03D 13/00
(52) U.S. Cl. ..... 4/309; 4/311; 4/426
(58) Field of Search ..... 4/222.1, 309, 310, 4/311, 426

(56) References Cited

U.S. PATENT DOCUMENTS

| | | | | |
|---|---|---|---|---|
| 3,047,013 A | | 7/1962 | Baumbach | |
| 4,016,609 A | | 4/1977 | Graham | |
| 4,180,875 A | * | 1/1980 | Wilson | 4/309 |

FOREIGN PATENT DOCUMENTS

| | | | | |
|---|---|---|---|---|
| DE | 50472 | | 5/1889 | |
| DE | 217221 | | 3/1909 | |
| FR | 1390081 | * | 12/1965 | 4/426 |
| FR | 2539779 | | 7/1984 | |
| GB | 2061103 | | 5/1981 | |
| WO | WO 94/25693 | | 11/1994 | |
| WO | WO 97/11234 | | 3/1997 | |

OTHER PUBLICATIONS

Hepworth Building Products Ltd. product brochure, hygienic self sealing waste valve, May 1997, UK, 2 pgs. English language translation of FR 1,390,081.*

* cited by examiner

*Primary Examiner*—Robert M. Fetsuga
(74) *Attorney, Agent, or Firm*—J. Charles Dougherty

(57) ABSTRACT

A waste outlet device adapted for use with a urinal and comprising one-way valve means (12).

5 Claims, 5 Drawing Sheets

WASTE OUTLET DEVICE

This invention relates to urinals of a type commonly found in men's lavatories. More specifically, this invention relates to a waste outlet device for a urinal.

Currently used urinal systems can be divided into two main categories. A first type, in which the receptacle is cleansed by a continuous stream of running water into a wall mounted cistern, containing a symphonic action flush apparatus, and a second type, in which the supply of water into the cistern is intermittent and controlled using,for example, via an electrically operated timing or passive infra red sensors in a solenoid valve fitted into the appropriate water supply pipe. Both types can be expensive and inefficient.

All urinal bowls use conventional water seal traps to prevent foul sewer gases entering washroom areas and also frequently use deodorising means to reduce unpleasant odours from waste pipes or channels. The odours are significantly worsened by the products of chemical reactions between water and urine leading to the solidification of salts found in urine which, together with limescale, accumulate in traps creating further problems of odours and blockages.

The present invention seeks to provide an improved urinal waste outlet device.

According to an aspect of the present invention, there is provided a urinal as specified in claim 1.

A suitable one-way valve comprises means for blocking the passage of gas in an upstream direction and means of allowing the passage of waste fluid in a downstream direction, the device being operable to temporarily unblock the waste pipe in the presence of waste fluid by means of an automatic reversible deformation. Preferably, the automatic reversible unblocking action occurs by a transformation of its shape from a closed to an open configuration and back.

Preferably, the waste outlet device including the one-way valve element is fitted into the urinal bowl or trough and is connected to the foul drain via the waste pipe.

Such an arrangement operates without the need for a constant or intermittent cleansing or flushing water supply. Because the waste pipe is ordinarily sealed from the foul drain, there is no need for conventional water seal traps or deodorising means. The device is preferably connected within the urinal bowl at the head of the waste pipe system position of the device and the means by which it is connected ensures that it is easily accessible from above the bowl for cleaning, maintaining, and replacing whole or part of the device.

The waste outlet device preferably also includes a device for reducing spattering and a perfumed or deodorising element.

An embodiment of the present invention is described below, by way of example only, with reference to the accompanying drawings, in which.

Figure 3:
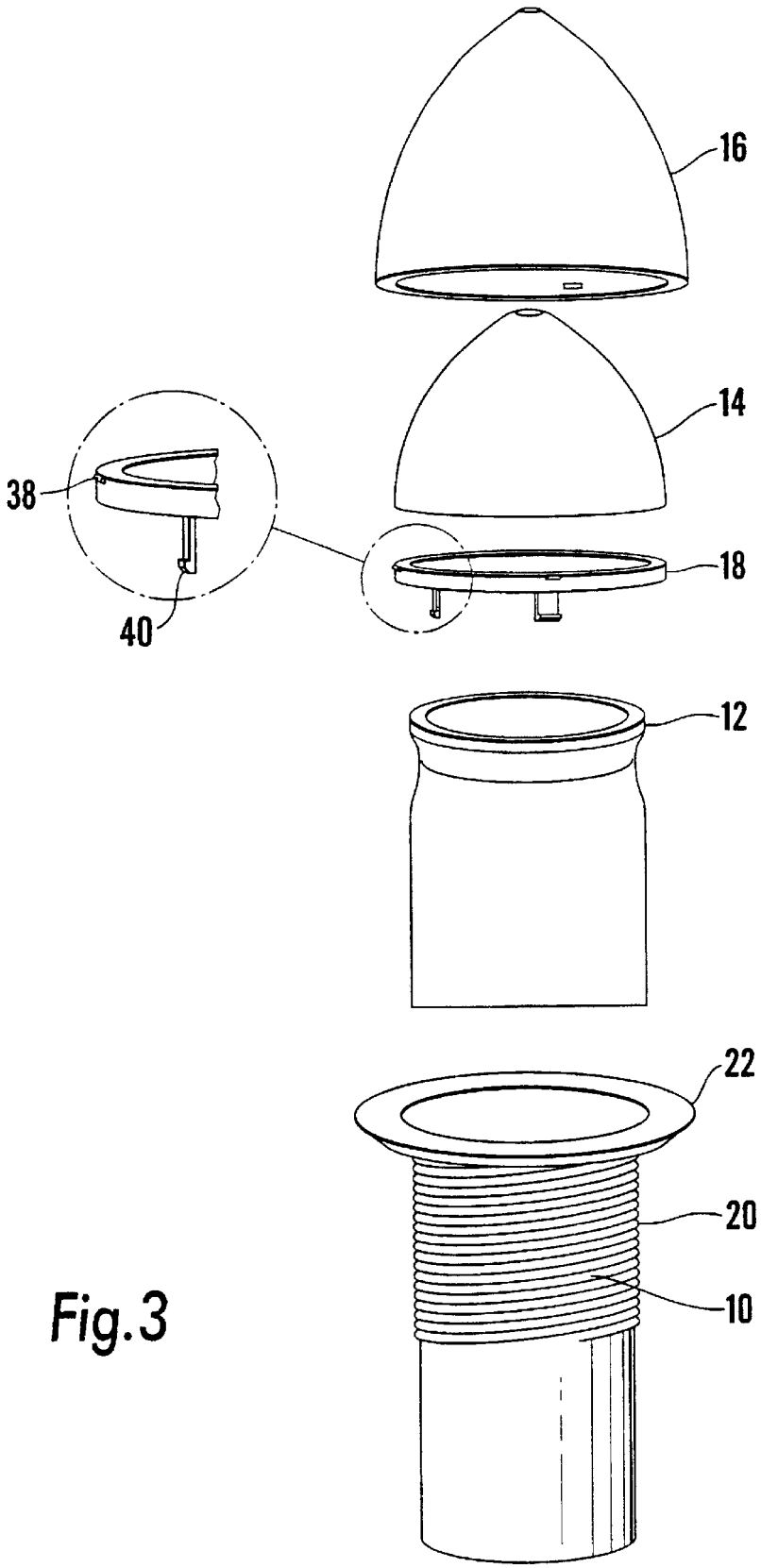
FIG. 3 is an exploded side view of a preferred waste outlet device.
Figure 4:
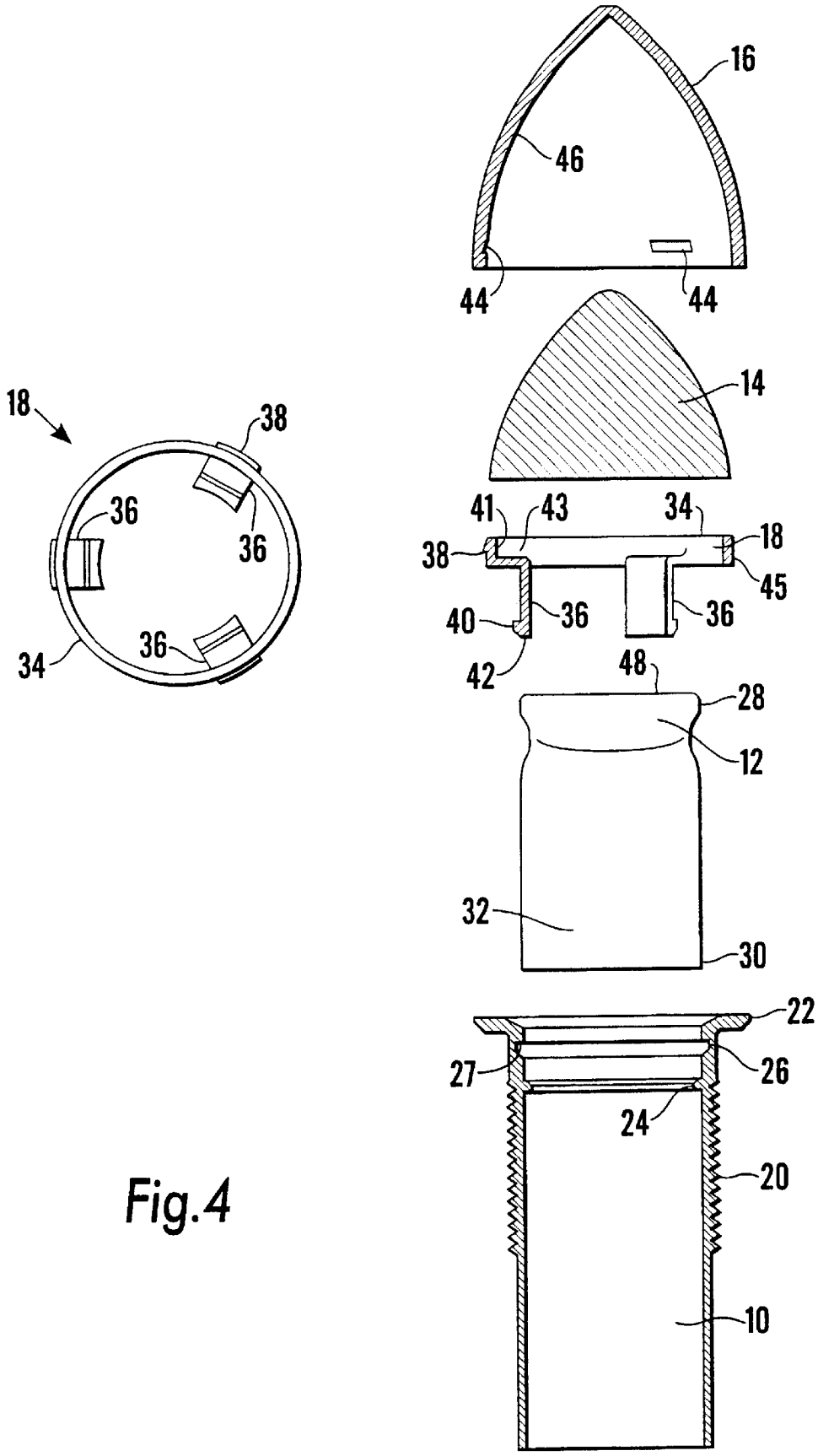
FIG. 4 is an exploded cross-sectional side view of the waste outlet device of FIG. 3.

With reference to FIGS. 3 and 4, the main components of a preferred waste outlet device are a sheath 10, a one-way valve element 12, a fragrance unit 14, an anti-spatter shield 16 and a retaining member 18.

Sheath 10 can be made of a moulded plastics material. It is a rigid cylindrical tube which is generally circular in plan view. A portion of the external wall 20 is threaded. An extended protruberance forms a circular lip 22 at the periphery of its upper extremity. Internally, an extended circular protrusion of the wall forms a rigid collar 24. Towards the upper extremity, a shallow groove 26 with a horizontal upper surface 27, runs around the inside of the sheath.

One-way valve element 12, in this example made of an elastomeric substance, generally adopts a flattened frusto-conical shape. This is to say, the upper portion 28 is formed in a substantially rigid annular shape, while the lower portion 26 is flattened so that a seal is made between abutting walls indicated at 32.

Retaining member 18 can be made of any suitable material. It 10 is formed in the shape of a ring 34 having inner 41 and outer 45 walls. In this example, there are three resiliently sprung arms 36 which are equally spaced around the circumference and project inwards and the downwards from the ring 34. Each arm 36 has a catch 40 and is formed with a flat 42 on the bottom surface. A number of upwardly protruding catches 38 are also formed on the outer wall 45 of the main ring 34.

Fragrance unit 14 is perforated and contains a perfume, which is typically, but not necessarily, either a liquid or a gel substance. Fragrance unit 14 need not be rigid or of any particular shape.

Anti-spatter cover 16 is shown as a rigid dome-shaped element. It is preferably chrome plated ABS plastic and has recesses 44 disposed at intervals around the bottom of the inner walls.

Figure 5:
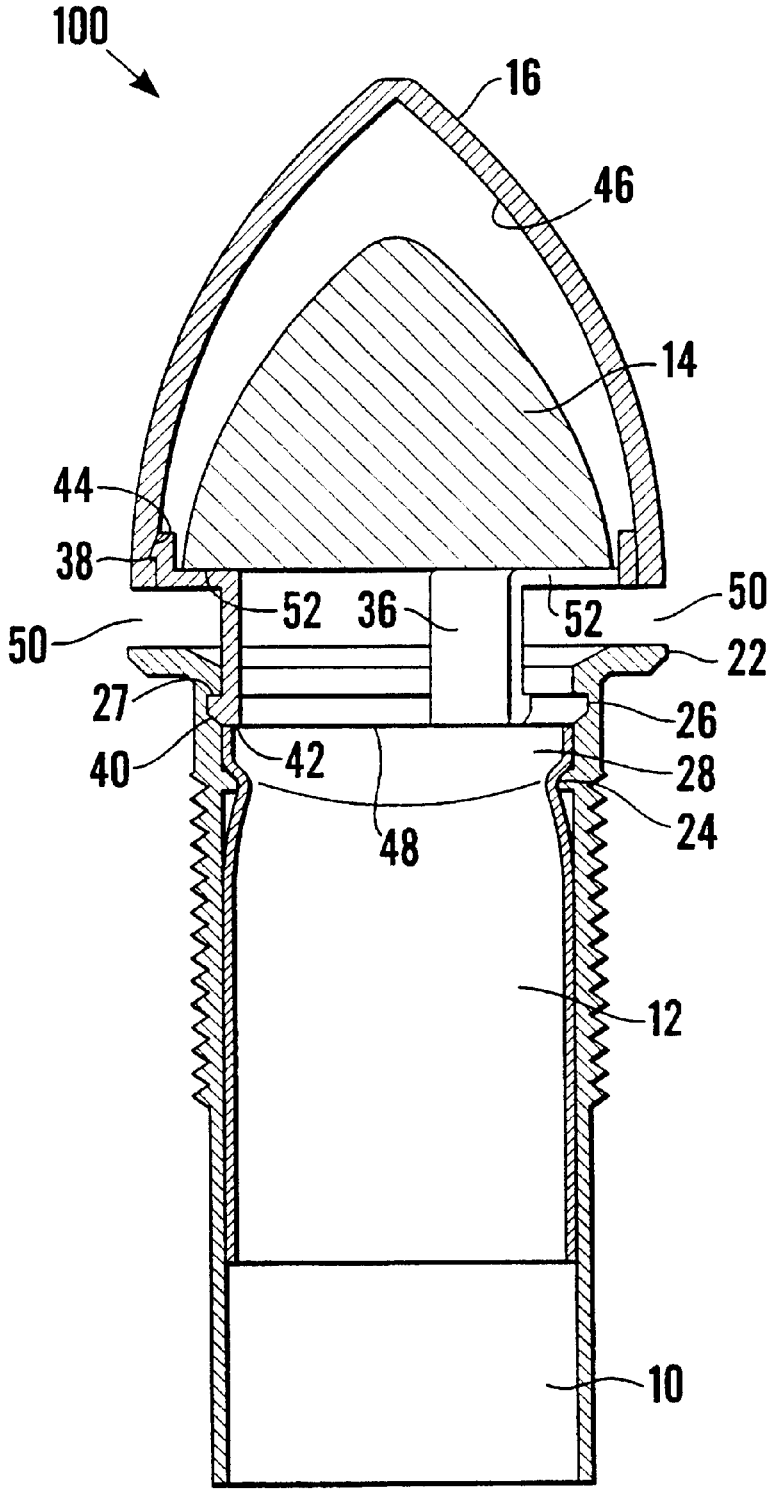
FIG. 5 is a cross-sectional side view of the waste outlet device of FIG. 3 in an assembled state.

With reference to FIG. 5, the assembled waste outlet device is shown with one-way valve element 12 inserted into sheath 10 so that the underside of annular portion 28 rests on collar 24. Retaining member 18 is positioned with the flats 42 of respective arms 36 abutting the upper surface 48 of one-way valve element 12, and thereby holds element 12 firmly in place. The catches 40 engage groove 26 and the horizontal upper surface 27 of the groove provides resistance to upward movement of the retaining member 18 and one-way valve element 12. The fragrance unit 14 is supported by the inwardly projecting horizontal portions 52 of respective arms 36. The anti-spatter cover 16 is positioned over the fragrance unit 14 and the catches 38 on the upper portion of the retainer member engage the recesses 44 on the inner walls 46 of the cover 16.

Figure 1:
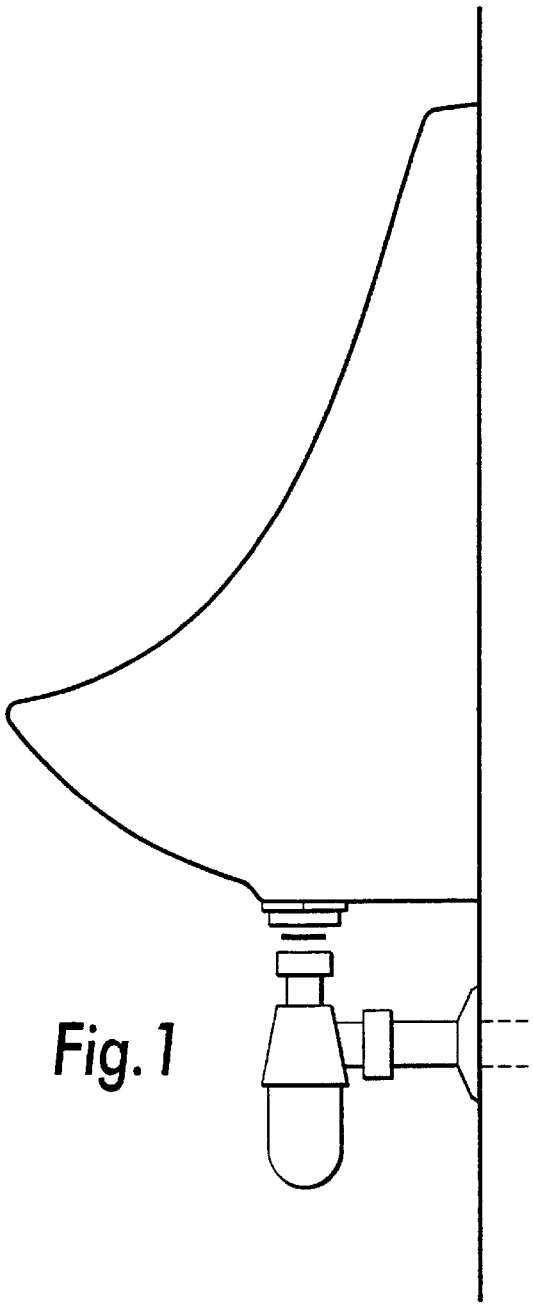
FIG. 1 is a side view of a urinal system incorporating a conventional waste outlet arrangement.
Figure 2:
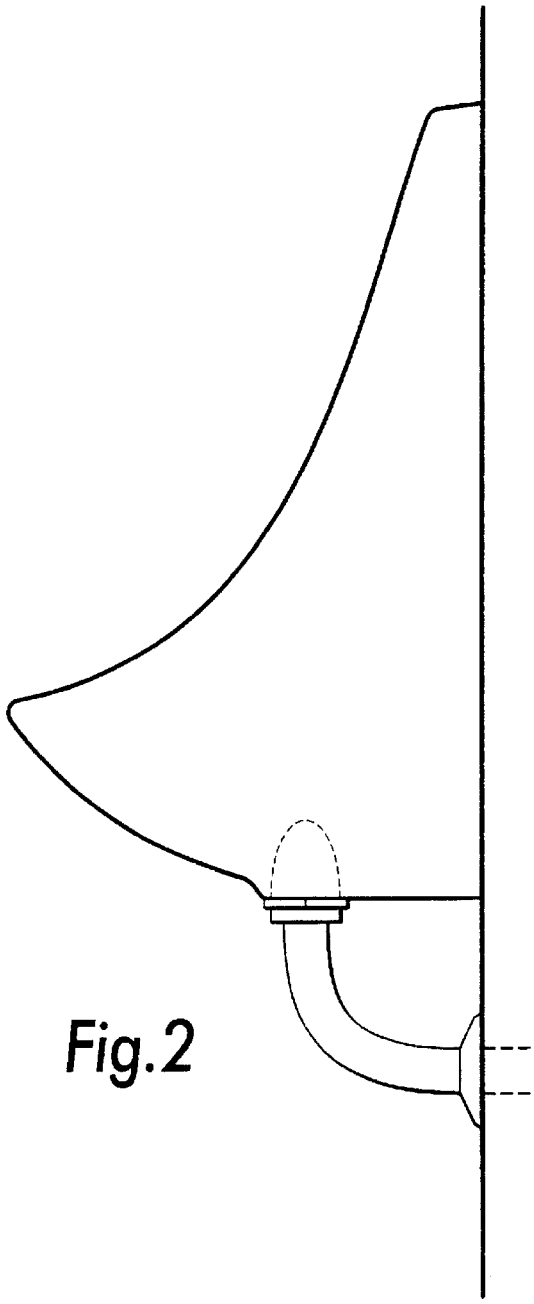
FIG. 2 is a side view of a urinal system incorporating a preferred waste outlet device.

In use, the threaded portion 20 is used to connect waste outlet device 100 substantially within the urine receptacle at the head of the waste pipe system. Typically, an internal portion of the waste outlet pipe adjoining the urinal from below is adapted to receive the threaded outer portion 20 of sheath 10. Referring to FIG. 2, the anti-spatter cover 16 can be seen (broken lines) protruding upwards into the urinal bowl.

When urine enters the bowl, it runs off the bowl walls and the anti-spatter cover 16, through an annular gap 50 (see FIG. 5) and over the lip 22 of sheath 10.

Before urine enters one-way valve element 12, the element is in the closed state (a flattened frusto-conical shape with abutting walls at 32 sealing the waste pipe from the urine receptacle), thereby preventing malodorous gases from leaking in an upstream direction. As urine enters, the shape of one-way valve element 12 undergoes a temporary deformation. During the deformation process, the shape of element 12 tends away from the flattened frusto-conical form and towards a more cylindrical form in which abutting walls at 32 become parted. In this condition, the seal is broken and the urine flows into the waste pipe. Once all the urine has passed through the waste outlet device, element 12 returns to a flattened frusto-conical shape, thereby re-establishing the seal between abutting walls 32.

A preferred waste outlet device permits a substantially waterless urinal system. For example, water is not necessary to maintain a minimum water level in a trap nor to wash/flush the bowl and waste pipe system, either continuously or intermittently. Thus vast quantities of water can be saved. Cleansing and maintenance operations are required only occasionally and all components of the waste outlet device are accessible from above the urinal bowl. The underside of the urinal bowl is free from the encumbrance of bulky fittings.

Malodourous gases are confined within the waste pipe network without the need for conventional U-bends, bottles or P-type traps. Use of the one way valve element obviates the need for each urinal waste pipe to have an air vent (vent pipe) as the system does not rely on waste seal traps and, therefore, is not effected by pressure variation in the waste pipe and problems associated with, leakage, compression, capillary action, wavering out, evaporation, momentum induced siphonage or self siphonage.

The components are simple and robust. Retainer member 18 can be released at catches 38, to permit removal of anti-spatter cover 16, for example to replace or maintain the fragrance unit 14. Alternatively, retainer 18 can be released at catches 40, to facilitate replacement or maintenance of the one-way valve element 12.

The device can be produced in any desirable size, for example to comply with 1.25 inch (32 mm) or 1.5 inch (40 mm) standard fittings or with any desirable connection means to enable use with different urine receptacle types, such as troughs and slabs. According to a modified version of the device, the upper portion of the waste pipe system provides the internal features of sheath 10, with element 12 being seated directly therein.

Figure 6:
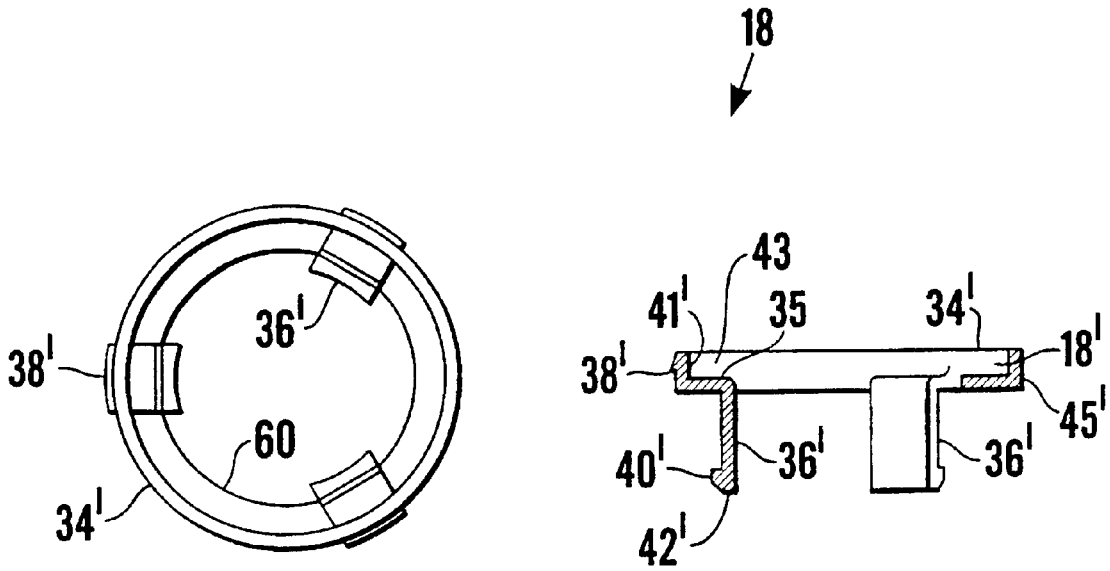
FIG. 6 is an alternative embodiment of retaining member 18.

Other modified versions of the waste outlet device may have different assembly configurations such as catch types. For example, with reference to FIG. 6, retaining member 18 can be in the form of an annular disk member having an upper surface 35 and a central opening which is slightly smaller in diameter than the base dimension of the fragrance unit 14. The resiliantly sprung arms 36' protrude directly from the inner portion 60 of the disk, whereas catches 38' are cut from outer wall 45'. This modified retainer member supports the fragrance unit 14 on the upper surface 35 of the annular disk member. In other respects it is similar to the corresponding member described earlier.

Instead of recesses 44, the antispatter cover 16 can be provided with a continuous annular groove circumscribing the inside of its dome at an appropriate level. Latches 38 engage portions around the annular groove in the same way as described for the recesses 44.

Although not strictly necessary, purpose built tools can be provided to assist in the removal of the various components for cleaning, maintenance or replacement.

A bayonet-type locking mechanism may be preferred to catch types 38 and 40. The various component parts may push fit into their respective positions to be held in place by gravity, or screw or be attached by any other suitable means It would also be possible to produce and supply the retainer 18, fragrance unit 14 and/or arti-spatter cover 16 as a single integral replacement unit.

To minimise unpleasant smells from the waste pipe system, it is generally preferred to connect the waste outlet device as far upstream as possible. That is not to say that one or more modified versions of the device cannot also be inserted at intervals downstream.

What is claimed is:

1. A urinal comprising a urinal bowl; a waste pipe; and a waste outlet device, wherein said waste outlet device comprises:

(a) a one-way valve that is removable from within the urinal bowl and comprises means for blocking the passage of gas in an upstream direction and for allowing the passage of waste fluid in a downstream direction, and comprises means to temporarily unblock said waste pipe in the presence of waste fluid by means of an automatic reversible deformation in shape;

(b) a sheath member for housing the one-way outlet valve and comprising an outer portion, wherein said outer portion is connectable with said waste pipe; and (c) a releasable retaining member for retaining the one-way valve in place inside the sheath member.

2. A device according to claim 1, wherein the retaining member (18) releasably retains an anti-spatter member (16).

3. A urinal according to claim 2, wherein the waste outlet device comprises at least one of a perfumed element and a deodorising element (14).

4. A urinal according to claim 3, wherein the waste outlet device comprises an anti-spatter member (16).

5. A urinal according to claim 4, wherein the at least one of a perfumed element and a deodorising element (14) is housed substantially within the anti-spatter member (16).

* * * * *